US005865203A

United States Patent [19]

Villano

[11] Patent Number: 5,865,203

[45] Date of Patent: Feb. 2, 1999

[54] HAND-HELD EXTENSOR FOR ASSISTANCE WITH WALKING AND REHABILITATION

[76] Inventor: Jean-Francois Villano, 238 W. 56th St., #5, New York, N.Y. 10019

[21] Appl. No.: 987,027

[22] Filed: Dec. 9, 1997

[51] Int. Cl.[6] ..... A45B 7/00

[52] U.S. Cl. ..... 135/65; 54/47; 119/770; 135/77

[58] Field of Search ..... 135/66, 65, 67, 135/68, 77; 54/47, 48; 119/770, 857; 244/151 R; 182/3

[56] References Cited

U.S. PATENT DOCUMENTS

| | | | |
|---|---|---|---|
| 627,328 | 6/1899 | Dickerman et al. . | |
| 634,604 | 10/1899 | Asche . | |
| 706,468 | 8/1902 | Wellman . | |
| 778,090 | 12/1904 | Wellmann . | |
| 1,738,581 | 12/1929 | Hodgson . | |
| 3,053,230 | 9/1962 | Klickstein et al. . | |
| 3,986,502 | 10/1976 | Gilson | 135/68 X |
| 4,351,324 | 9/1982 | Bronkhorst | 128/80 |
| 4,493,334 | 1/1985 | Semanchik | 135/75 |
| 4,747,423 | 5/1988 | Hansen | 135/68 |
| 4,884,587 | 12/1989 | Mungons | 135/66 X |
| 5,183,007 | 2/1993 | Vincent . | |
| 5,348,035 | 9/1994 | Porter | 135/66 |
| 5,575,299 | 11/1996 | Bieri | 135/66 |
| 5,598,812 | 2/1997 | Graham et al. . | |
| 5,664,844 | 9/1997 | Greene . | |
| 5,718,189 | 2/1998 | Blake . | |

FOREIGN PATENT DOCUMENTS

| | | | |
|---|---|---|---|
| 1771736 | 10/1992 | U.S.S.R. | 135/67 |

*Primary Examiner*—Lanna Mai

[57] ABSTRACT

A hand-held extensor for assistance with walking and rehabilitations includes a foot stirrup assembly, which has a foot stirrup strap, and a foot support means, the foot support means further comprises a top surface and bottom surface. A lower strap is securely attached to the top of foot stirrup assembly, through an aperture formed within the foot stirrup strap, the lower strap having a foot stirrup assembly securement means securely mounted thereon, which functions to regulate movement of the foot stirrup assembly, the lower strap further having a length adjustment means securely mounted thereon. An upper strap is removably attached to a top distal edge of the lower strap, the upper strap having a handle securement means securely mounted thereon. A handle is securely connected to a top distal edge of the upper strap by a handle connection strap, the handle to be gripped by a user functioning to allow the user to pull upwardly on the handle to raise the foot stirrup assembly, providing the user assistance with walking and rehabilitation. Alternate embodiments of the invention include the use of a belt and/or shoulder harness to provide increased leverage for lifting the foot stirrup assembly, giving the user the ability to walk with minimal upper body strength.

13 Claims, 6 Drawing Sheets

110
134
130
130A
130B
130A
130
130A
130B
130A
20
20
10
10

HAND-HELD EXTENSOR FOR ASSISTANCE WITH WALKING AND REHABILITATION

BACKGROUND OF THE INVENTION

1. Field of the Invention

The present invention relates to a walking assistance device. More particularly, the present invention is a device to assist one who is physically disabled by motor paralysis or injured in walking or climbing steps. The device is essentially a hand-held handle grip or grips wherein at least one strap descends from the hand grip to a foot housing assembly that wraps around the bottom of one or both of the user's feet. The user's foot inserts into the foot housing assembly, enabling the user to use his or her upper body strength to help lift the leg by pulling upwardly on the handle or handles when walking on a flat surface or climbing stairs. This is particularly useful for those stricken with conditions causing paralysis in the lower body, but can also be effective for those with a broken leg, or those undergoing the rehabilitation process, as usage of this device more closely simulates natural walking than traditional crutches or walkers. In alternate embodiments according to the degree of paralysis and lack of movement in the user's legs, the device may include a belt-like harness or shoulder-strap assembly. These provide considerably extra stability to the user and allow the user to utilize extra leverage so that the leg can be lifted with minimal movement of the user's arm and upper body.

2. Description of the Prior Art

Numerous innovations for walking assistance devices have been provided in the prior art that are described as follows. Even though these innovations may be suitable for the specific individual purposes to which they address, they differ from the present invention as hereinafter contrasted.

1. U.S. Pat. No. 4,351,324. Inventor—Bronkhorst

The patent by Bronkhorst discloses a therapeutic walking device has features to aid sufferers from cerebral palsy in reducing the tendency to walk on the balls of the foot. The device includes a foot section and a calf section formed at a 90 degree angle. The foot section has a heel support and a toe support for supporting the heel and toes of the user. A recessed section separates the heel support and toe support and is spaced lower so as to prevent pressure from being exerted on the sole of the foot between the heel and toes. The leg section is strapped about the calf of the user's leg.

2. U.S. Pat. No. 5,575,299. Inventor—Bieri

The patent by Bieri teaches the use of a walking device which will approximate the natural walking style of a person while providing support and balance. The device is designed to be easily modified to accommodate individual different heights and body weights. The walking device has a foot member, a support member, and a body member attached to the support member opposite the foot member. The body member has means for attaching the device to the lower portion of the human leg.

3. U.S. Pat. No. 4,493,334, Inventor—Semanchik

The patent by Semanchik describes a walking aid which includes a shaft formed of nested telescoping sections which can be readily secured and locked in the adjusted position and which has connected to one end thereof a foot pad having an arcuate sole portion simulating an anatomical foot and a handle portion connected to the other end whereby the handle is constructed so that when grasped the bearing weight of the user is on the hypothermal eminence of the hand which is the anatomically weight bearing surface of the hand. The aid may be provided with one of several distinct handle arrangements which may function as a hand guard, provide illumination and/or arrange to be disposed relative to the foot pad to define and arc of a circle. The foot pad and connected shaft and handle are balanced so that the aid is naturally maintained in an upright position.

4. U.S. Pat. No. 4,747,423. Inventor—Hansen

The patent by Hansen describes a reducible walking aid is disclosed that incorporates three bitubular sections in slidable engagement with one another in the preferred embodiment. The first and third sections are connected via a pair of elastic cables attached to slidable, bidirectional hinge elements anchored to the near ends of the first and third sections, with the cables running through the tubular sections of the second section. To reduce the size of the walking aid, one pulls in opposite directions on the first and second bitubular sections. Once the hinges arc generally clear of the second section, the first section is folded over the second section in one direction. The third section is folded in the opposite direction in a similar fashion to accomplish the complete folding of the crutch. To restore the walking aid to its original operating size, one grasps the folded first and third sections and opens them until they are in generally axial alignment with the second section, at which time the first and third sections slide into the second to provide a rigid vertical support. Means are also provided for adjusting the height of the walking aid both below and above the hand grip. The hand grip is of novel design and is adjustable along an infinite number of positions on the second section.

The present invention, in all instances, either accomplishes a different purpose than the above-described inventions, or does so in a novel useful, and non-obvious manner that still effectively achieves its intended result. The above-described patents primarily protect items such as those that include a telescopic solid constructions to aid in walking in the manner of a crutch. The other inventions are therapeutic devices designed specifically to assist the disabled in applying optimal levels of pressure to all areas of the foot. The present invention, in contrast, teaches the use of a device to attach to and around the user's foot for the purpose of allowing the user to lift the leg during walking with greater ease.

SUMMARY OF THE INVENTION

The present invention is a device to assist one who is physically or mentally disabled or injured in walking or climbing steps. The device is essentially a hand-held handle grip or grips wherein at least one strap descends from the hand grip to a foot housing assembly that wraps around the bottom of one or both of the user's feet. The user's foot inserts into the foot housing assembly, enabling the user to use his or her upper body strength to help lift the leg by pulling upwardly on the handle or handles when walking on a flat surface or climbing stairs.

This is particularly useful for those stricken with conditions causing temporary or permanent paralysis in the lower body that is partial or complete. The device can also be effective for those with a broken leg, or those undergoing the rehabilitation process. It is submitted that usage of this device is far more effective for rehabilitative purposes than traditional single or dual walking sticks or canes, as the hand-held extensor for assistance with walking and rehabilitation more closely simulates natural walking than traditional crutches or walkers. Crutches or walkers inherently encourage a jumping-type forward motion for the user, which does not closely resemble normal walking movements. As may be expected, such devices, through their strong emphasis on upper body strength, create muscle fatigue quickly, reducing the duration of all walks. Usage of the device described herein will not only help strengthen the leg muscles more quickly, greatly reducing recovery and rehabilitation time, but allow the user to walk for longer periods of time to greater distances..

In alternate embodiments according to the degree of paralysis and lack of movement in the user's legs, the device may include a belt-like harness or shoulder-strap assembly, to be described in far greater detail hereinafter. For instance, one with Parkinson's Disease or an infliction associated with similar degrees of paralysis may require an embodiment of the invention which includes the use of either a belt or combination belt / shoulder harness to provide as much leverage and as little work on the user's upper body as is possible. Similarly, one with a condition that still allows for minimal natural movement of the afflicted leg or legs may be able to utilize the original embodiment of the invention, wherein no belt or shoulder harness is included. These provide considerably extra stability to the user, and allow the user to utilize extra leverage so that the leg can be lifted with minimal movement of the user's arm and upper body. The fact that the tension of the device can be varied in this manner is of paramount importance as the degree of disability and paralysis of all parts of an inflicted person's body of course varies considerably. With greater the tension provided by each embodiment of the hand-held extensor, less strength is needed from the user's forearms and upper body.

In keeping with these objects, and with others which will become apparent hereinafter, one feature of the present invention resides, briefly stated, in that the device may be constructed for walking and rehabilitative assistance for those with disabilities or injuries affected either or both legs.

Another advantage of the hand-held extensor is that such is constructed of lightweight materials, allowing for persons of all ages and conditions to simply operate the device. Furthermore, the hand-held extensor is compact, enabling the user to store the device in the user's pocket or tote bag during instances of non-use.

Still another advantage of the hand-held extensor is that the device can just as easily be used for ascending and descending stairs as it can for walking forwardly on a flat surface. For instance, a user with only one disabled leg can accomplish this most effectively by simply raising the non-disabled leg to a higher step first, and using the extensor to lift the disabled leg to the same step thereafter. The device can also be used on stairs for those with both legs disabled, at which instance only the time of ascending and descending the steps is affected.

Perhaps the greatest benefit of the hand-held extensor for assistance with walking and rehabilitation is its positive psychological effects. It is respectfully submitted that the user of the extensor can better walk and climb up and down stairs than with any other walking assistance device. Moreover, the user can do this in a way that most closely simulates natural walking, enabling the user to feel less different than those unaffected by paralysis or injury, and more positive about their overall appearance when surrounded by others. As previously noted, because this device puts very little strain on the upper body muscles, and because it encourages strengthening of the leg muscles, the user can walk freely to more public places further away than with any other device.

The novel features which arc considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF DESCRIPTION OF THE PREFERRED EMBODIMENT

DETAILED DESCRIPTION OF THE PREFERRED EMBODIMENT

Figure 1:
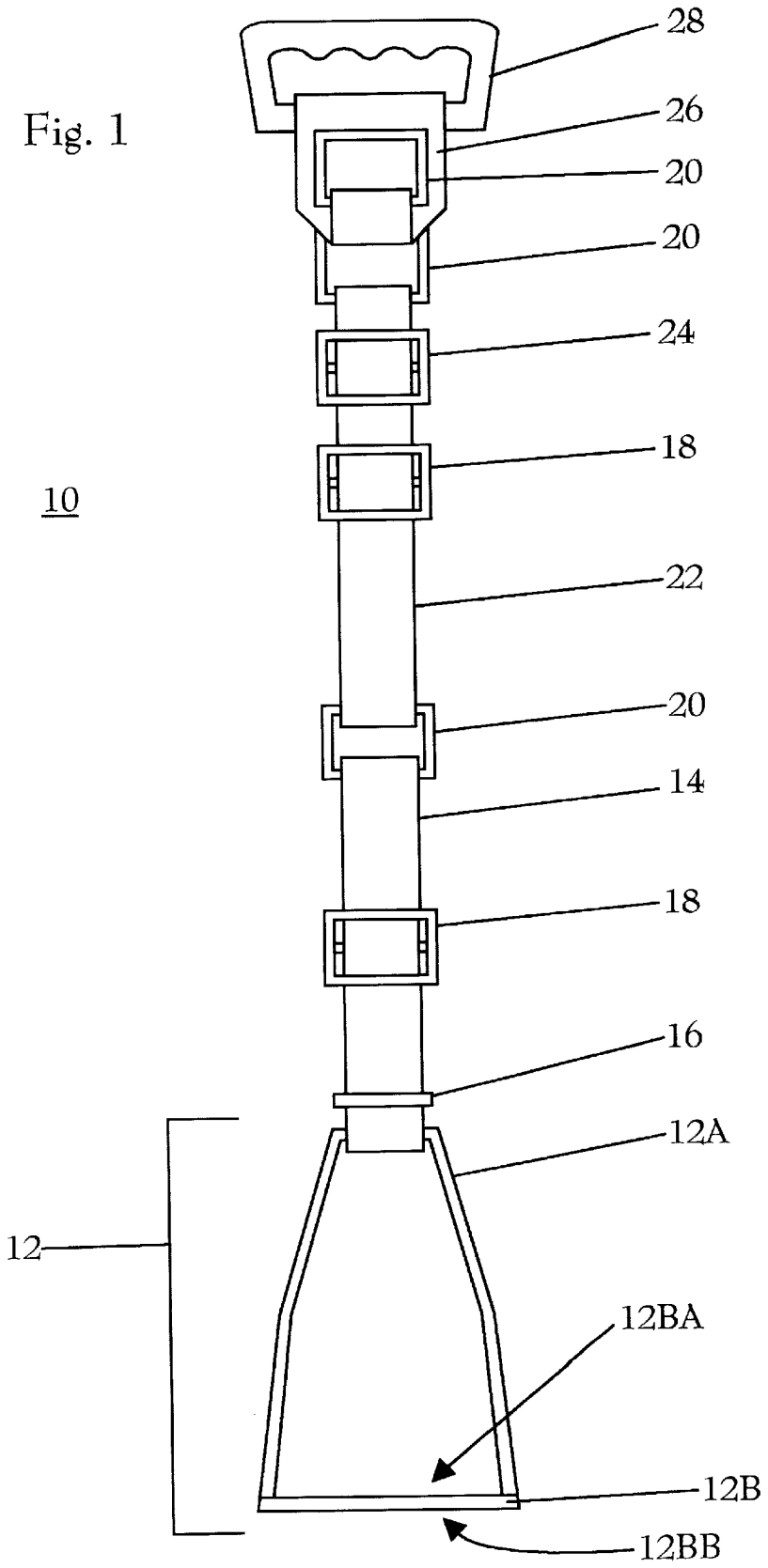
FIG. 1 is a frontal view of the hand-held extensor for assistance with walking and rehabilitation in its first embodiment.

Firstly, referring to FIG. 1, which is a frontal view of the hand-held extensor for assistance with walking and rehabilitation in its first embodiment: A hand-held extensor for assistance with walking and rehabilitation (10) is shown comprising: a foot stirrup assembly (12), which comprises a foot stirrup strap (12A), and a foot support means (12B), the foot support means (12B) further comprises a foot support means top surface (12BA) and a foot support means bottom surface (12BB). The construction is intended for the user placing one foot into a foot stirrup assembly (12) with the bottom of the user's foot placed upon the foot support means top surface (12BA). A lower strap (14) is securely attached to the top of foot stirrup assembly (12), through an aperture or loop formed within the foot stirrup strap (12A). The lower strap (14) has a foot stirrup assembly securement means (16) securely mounted thereon, the foot stirrup assembly securement means (16) functioning to regulate movement of the foot stirrup assembly (12) so it does not slip making usage of the device more difficult. The lower strap (14) further has a length adjustment means (18) securely mounted thereon so that the length of the item can be adjusted to account for height differences for each user. An upper strap (22) is removably attached to a top distal edge of the lower strap (14) by a connection means (20), the upper strap (22) having a handle securement means (24) securely mounted thereon. A handle (28) is securely connected to a top distal edge of the upper strap (22) by a handle connection strap (26). The handle (28) is intended to be gripped by a user functioning to allow the user to pull upwardly on said handle (28), placing tension on the upper strap (22) and elastic lower strap (14) to raise the foot stirrup assembly (12), providing the user assistance with walking and rehabilitation. The foot support means top surface (12BA) preferably includes a non-skid substance which functions to prevent slippage of the user's foot within the foot stirrup assembly (12). The foot support means bottom surface (12BB) preferably includes a non-skid substance which functions to prevent slippage of the foot stirrup assembly (12) on a flat surface. The lower strap (14) is preferably manufactured from an elastic material, which allows the user to more easily lift the foot stirrup assembly (12). The handle (28) may include a padded material which functions to provide the user additional comfort, which will contribute to allowing the user to extend the duration of walks.

Figure 2:
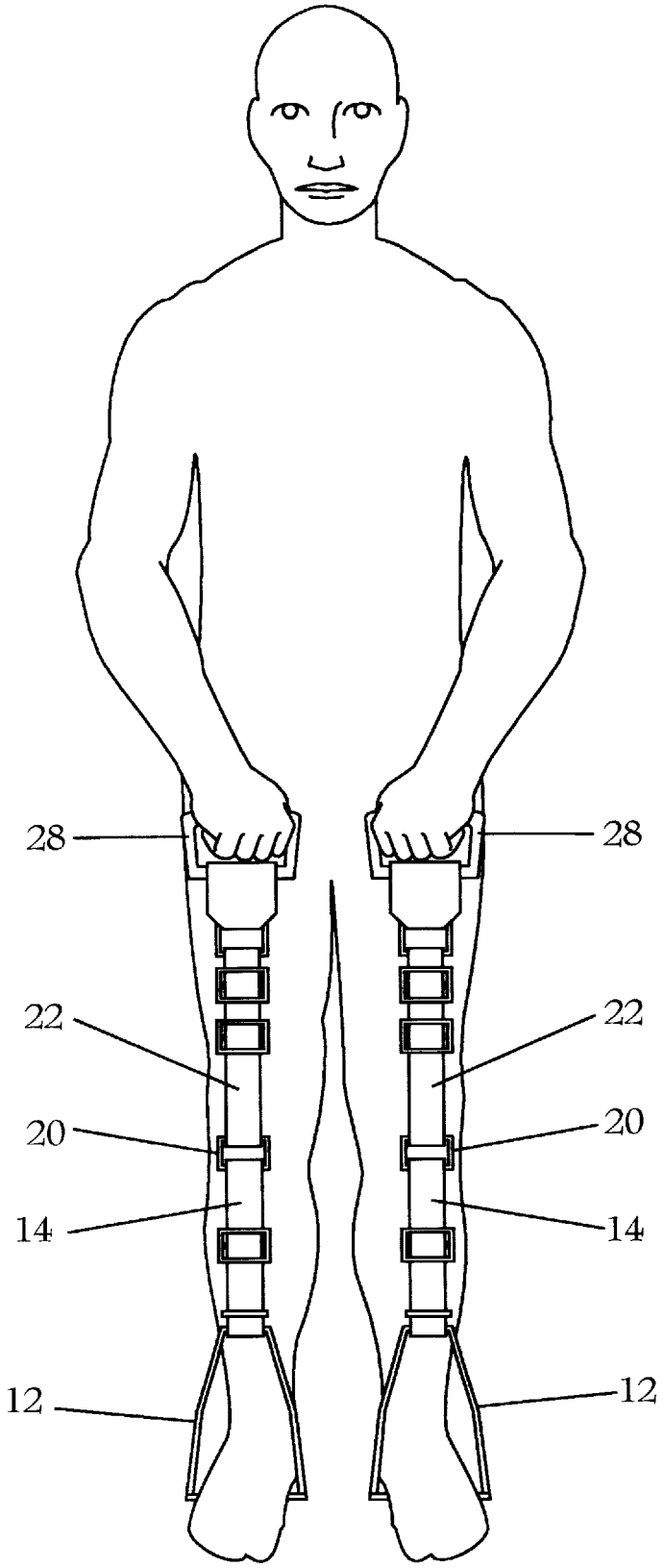
FIG. 2 is a frontal view of the hand-held extensor for assistance with walking and rehabilitation in its first embodiment, showing the device in use for both legs.

Secondly, referring to FIG. 2, which is a frontal view of the hand-held extensor for assistance with walking and rehabilitation in its first embodiment, showing the device in use for both legs: the device may be constructed for walking and rehabilitative assistance for those with disabilities or injuries affected either or both legs, in which case the embodiment detailed in the description of FIG. 1 remains the same for each leg.

Figure 3:
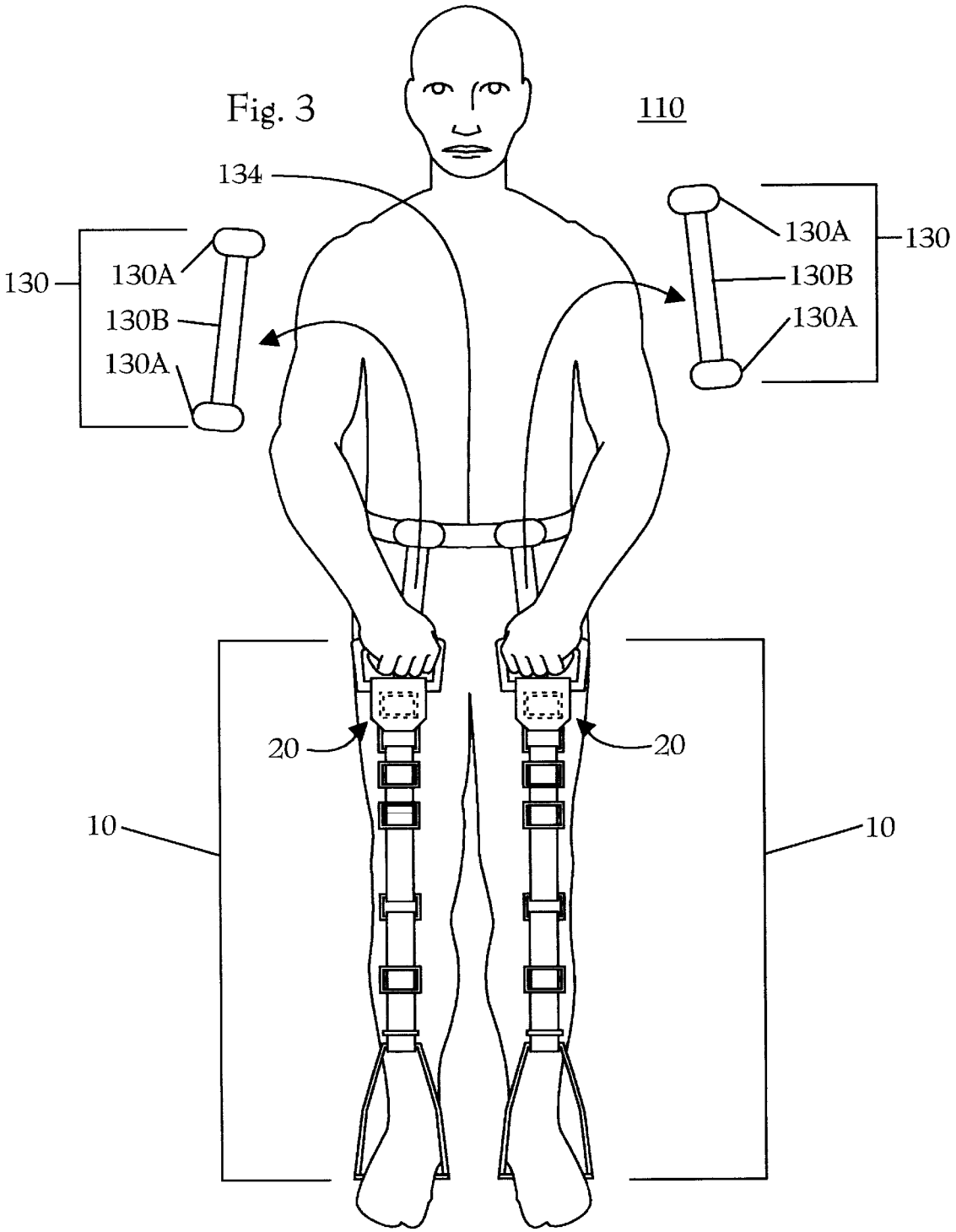
FIG. 3 is a frontal view of the hand-held extensor for assistance with walking and rehabilitation being worn by a user in its second embodiment, including removable belt harness.

Next, referring to FIG. 3, which is a frontal view of the hand-held extensor for assistance with walking and rehabilitation being worn by a user in its second embodiment, including removable belt harness: a belt assembly (130) is removably connected to an edge of the upper strap (22) facing inwardly to the user by a clasp connector (130A). The clasp connector (130A) is securely connected to a belt connection strap (130B), the belt connection strap (130B) connected to a belt (134) by a second clasp connector (130A). The belt assembly (130) functions to allow the user to also lift the handle (18) outwardly from the user in order to aid in the lifting of the user's leg. For organization purposes, the addition of the belt assembly (130) forms hand-held extensor for assistance with walking and rehabilitation numbered herein as (110). In this embodiment, the belt (134) may be a pre-existing separate belt removably connected to the clasp connector (130A). Alternatively the device (110) may be a single-piece unit in which case the belt (134) is securely attached to the clasp connector (130A).

Figure 4:
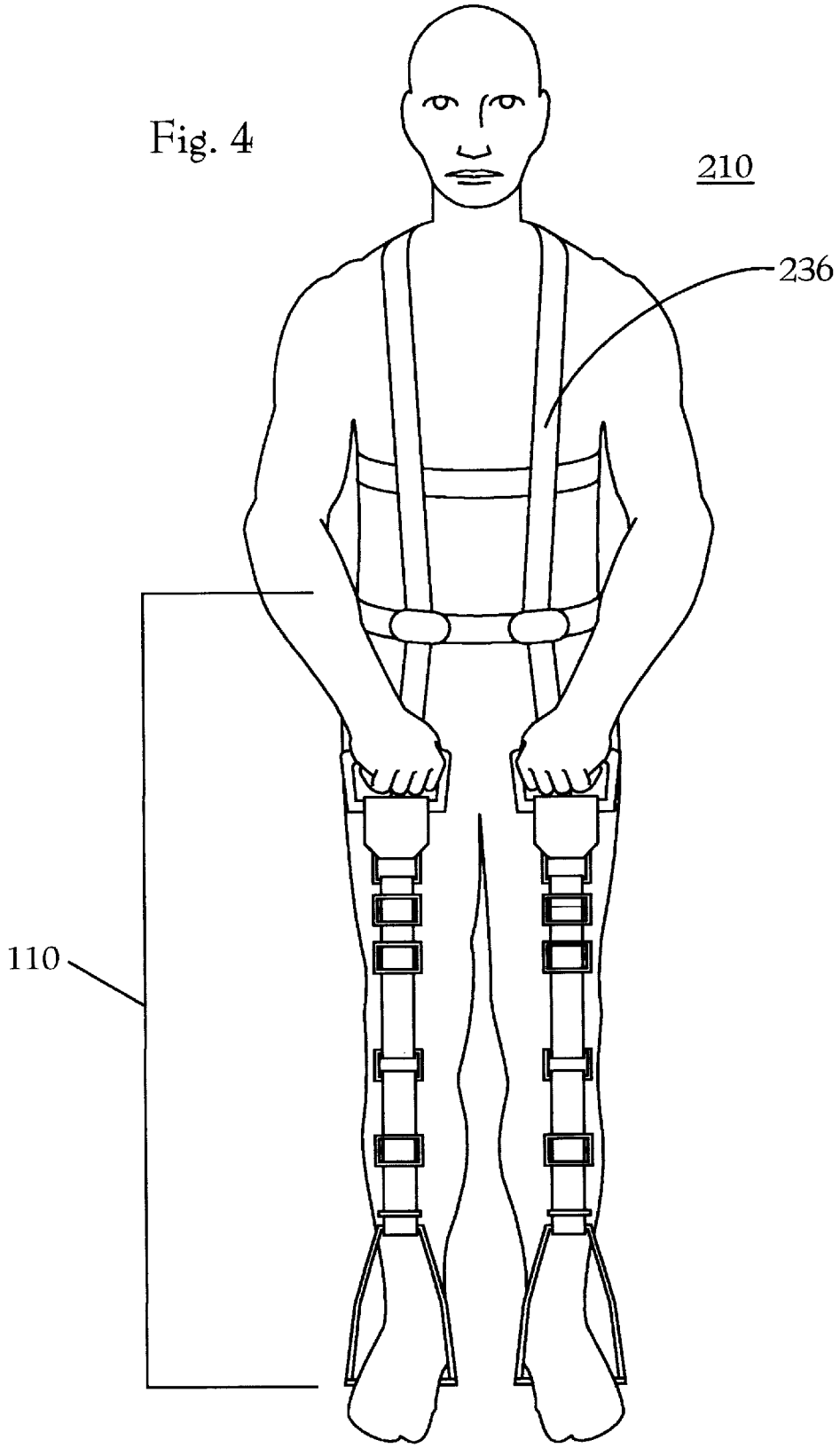
FIG. 4 is a frontal view of the hand-held extensor for assistance with walking and rehabilitation being worn by a user in its third embodiment, including shoulder ha r use with the device on both legs.

Next, referring to FIG. 4, which is a frontal view of the hand-held extensor for assistance with walking and rehabilitation being worn by a user in its third embodiment, including shoulder harness for use with the device on both legs: an upper body harness (236) is removably connected to the belt (134) by means of at least one clasp connector (130A), the upper body harness (236) functioning to provide the user additional leverage with which to lift the user's legs. Once again for the purposes of organization, the addition of the upper body harness (236) forms third embodiment of hand-held extensor for assistance with walking and rehabilitation numbered herein as (210). This embodiment is suitable for providing increased leverage and stability to one with both legs disabled. Specifically, this double harness is inherently counterbalanced, with equal weight and tension distributed across the user's upper body, providing optimal leverage and stability.

Figure 5:
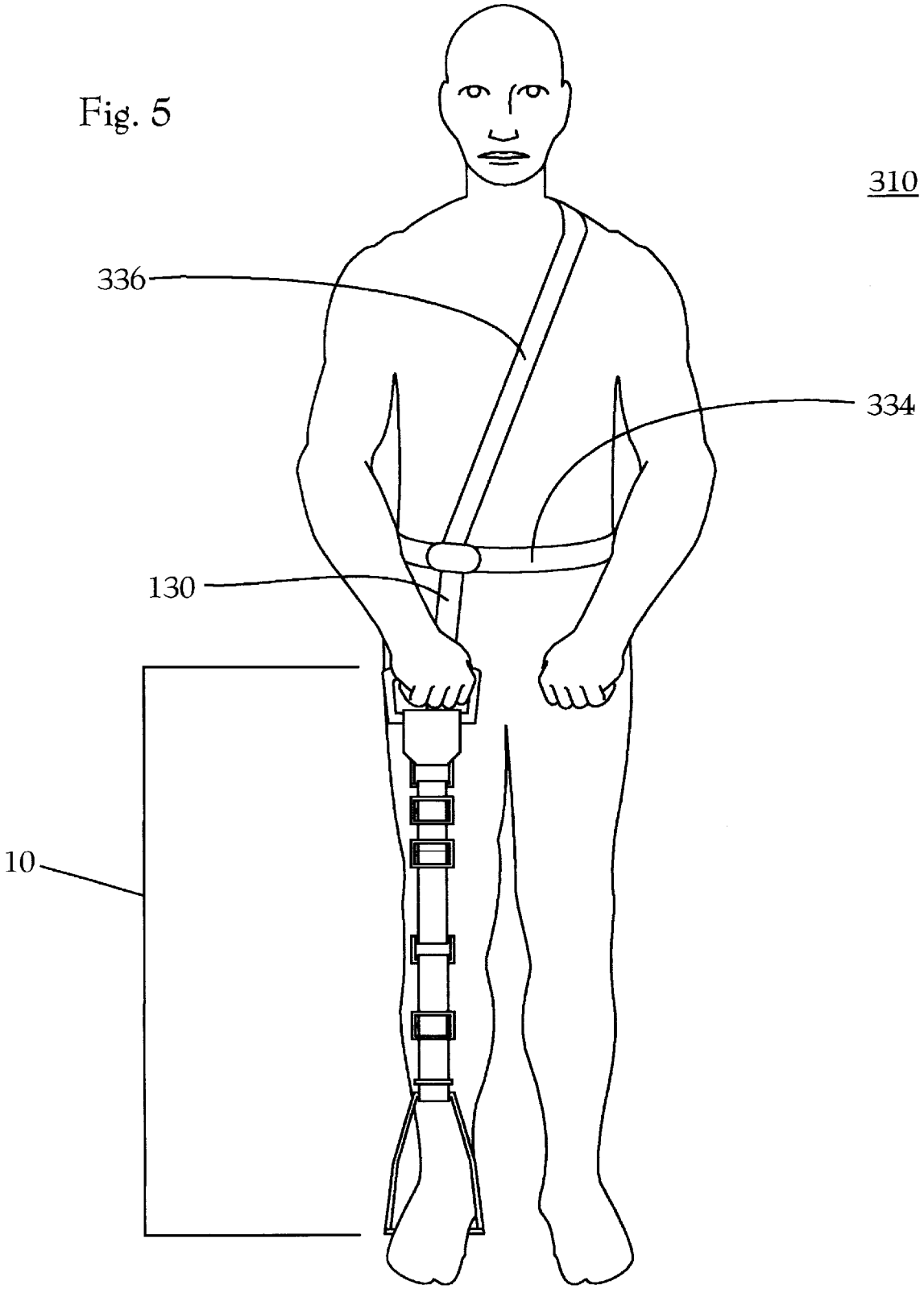
FIG. 5 is a frontal view of the hand-held extensor for assistance with walking and rehabilitation being worn by a user in its third embodiment, including shoulder harness for use with the device on one leg.

Next, referring to FIG. 5, which is a frontal view of the hand-held extensor for assistance with walking and rehabilitation being worn by a user in its third embodiment, including shoulder harness for use with the device on one leg: an upper body harness (336) is removably connected to the belt (334) by means of at least one clasp connector (130A), the upper body harness (336) functioning to provide the user additional leverage with which to lift the user's leg, addition of the upper body harness (336) forming fourth embodiment of hand-held extensor for assistance with walking and rehabilitation (310). This embodiment is most suitable for providing increased leverage and stability to one with one leg disabled. Specifically, this single harness is counterbalanced as well, as weight and tension are distributed across the opposite side of the user's upper body, providing effective leverage and stability.

Figure 6:
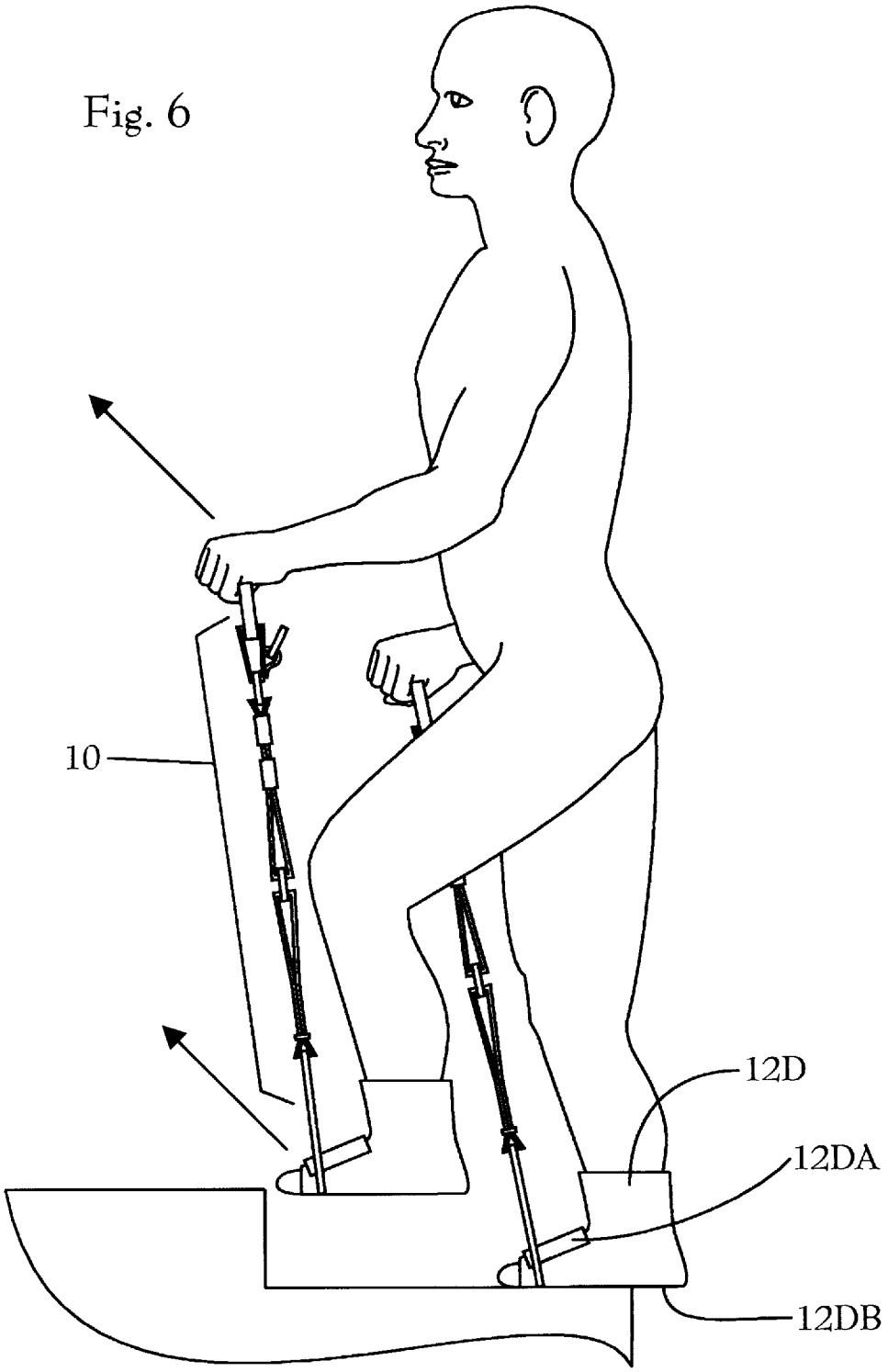
FIG. 6 is a profile view of the hand-held extensor for assistance with walking and rehabilitation in use during walking and climbing stairs.

Finally, referring to FIG. 6, which is a profile view of the hand-held extensor for assistance with walking and rehabilitation in use during walking and climbing stairs: the foot stirrup assembly (12) shown comprises a foot securement housing (12D) securely connected therein, the foot securement housing (12D) comprising a foot securement means (12DA) and a foot securement housing bottom surface (12DB). The foot securement housing (12D) functions to act as a prefabricated shoe included in construction of the device, in which to hold the user's foot. The a foot securement means (12DA) may be an adjustable strap, fastened by means of laces, hook and loop fasteners, or other fastening means in order to tightly hold the foot in place, facilitating lifting of the foot stirrup assembly (12). The foot securement housing bottom surface (12DB) includes a non-skid substance which functions to prevent slippage of the foot stirrup assembly (12) on a flat surface, much like that described in FIG. 1.

It will be understood that each of the elements described above, or two or more together, may also find a useful application in other types of constructions differing from the type described above.

While the invention has been illustrated and described as embodied in an ancillary skateboard roller apparatus, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, constitute essential characteristics of the generic or specific aspects of this invention.

What is claimed as new and desired to be protected by letters patent is set forth in the appended claims:

What is claimed is:

1. A hand-held extensor for assistance with walking and rehabilitation (10) comprising:

A) a foot stirrup assembly (12), which comprises a foot stirrup strap (12A), and a foot support means (12B), the foot support means (12B) further comprises a foot support means top surface (12BA) and a foot support means bottom surface (12BB);

B) a lower strap (14) securely attached to the top of foot stirrup assembly (12), through an aperture formed within the foot stirrup strap (12A), the lower strap (14) having a foot stirrup assembly securement means (16) securely mounted thereon, the foot stirrup assembly securement means (16) functioning to regulate movement of the foot stirrup assembly (12), the lower strap (14) further having a length adjustment means (18) securely mounted thereon;

C) an upper strap (22) removably attached to a top distal edge of the lower strap (14) by a connection means (20), the upper strap (22) having a handle securement means (24) securely mounted thereon; and D) a handle (28) securely connected to a top distal edge of the upper strap (22) by a handle connection strap (26), the handle (28) to be gripped by a user functioning to allow the user to pull upwardly on said handle (28) to raise the foot stirrup assembly (12), providing the user assistance with walking and rehabilitation.

2. The hand-held extensor for assistance with walking and rehabilitation (10) as described in claim 1, wherein the foot support means top surface (12BA) includes a non-skid substance which functions to prevent slippage of the user's foot within the foot stirrup assembly (12).

3. The hand-held extensor for assistance with walking and rehabilitation (10) as described in claim 1, wherein the foot support means bottom surface (12BB) includes a non-skid substance which functions to prevent slippage of the foot stirrup assembly (12) on a flat surface.

4. The hand-held extensor for assistance with walking and rehabilitation (10) as described in claim 1, wherein the lower strap (14) is manufactured from an elastic material.

5. The hand-held extensor for assistance with walking and rehabilitation (10) as described in claim 1, wherein the handle (28) includes a padded material which functions to provide the user additional comfort.

6. The hand-held extensor for assistance with walking and rehabilitation (10) as described in claim 1, wherein the handle (28) includes a padded material which functions to provide the user additional comfort.

7. The hand-held extensor for assistance with walking and rehabilitation (10) as described in claim 1, wherein a belt assembly (130) is removably connected to an edge of the upper strap (22) facing inwardly to the user by a clasp connector (130A), the clasp connector (130A) securely connected to a belt connection strap (130B), the belt connection strap (130B) connected to a belt (134) by a second clasp connector (130A), the belt assembly (130) functioning to allow the user to also lift the handle (18) outwardly from the user to aid in the lifting of the user's leg, addition of the belt assembly (130) forming hand-held extensor for assistance with walking and rehabilitation ( 110).

8. The hand-held extensor for assistance with walking and rehabilitation (110) as described in claim 7, wherein the belt (134) is a pre-existing separate belt removably connected to the clasp connector (130A).

9. The hand-held extensor for assistance with walking and rehabilitation (110) as described in claim 7, wherein the device (110) is a single-piece unit and the belt (134) is securely attached to the clasp connector (130A).

10. The hand-held extensor for assistance with walking and rehabilitation (110) as described in claim 7, wherein an upper body harness (236) is removably connected to the belt (134) by means of at least one clasp connector (130A), the upper body harness (236) functioning to provide the user additional leverage with which to lift the user's legs, addition of the upper body harness (236) forming third embodiment of hand-held extensor for assistance with walking and rehabilitation (210).

11. The hand-held extensor for assistance with walking and rehabilitation (10) as described in claim 10, wherein the foot securement housing bottom surface (12DB) includes a non-skid substance which functions to prevent slippage of the foot stirrup assembly (12) on a flat surface.

12. The hand-held extensor for assistance with walking and rehabilitation (110) as described in claim 7, wherein an upper body harness (336) is removably connected to the belt (334) by means of at least one clasp connector (130A), the upper body harness (336) functioning to provide the user additional leverage with which to lift the user's legs, addition of the upper body harness (336) forming fourth embodiment of hand-held extensor for assistance with walking and rehabilitation (310).

13. The hand-held extensor for assistance with walking and rehabilitation (10) as described in claim 1, wherein the foot stirrup assembly (12) further comprises a foot securement housing (12D) securely connected therein, the foot securement housing (12D) comprising a foot securement means (12DA) and a foot securement housing bottom surface (12DB), the foot securement housing (12D) functioning to act as a shoe in which to hold the user's foot.

* * * * *